United States Patent [19]

Davis

[11] Patent Number: 4,706,636

[45] Date of Patent: Nov. 17, 1987

[54] PURGE AND PRIME FUEL DELIVERY SYSTEM AND METHOD

[75] Inventor: Leland L. Davis, Saline, Mich.

[73] Assignee: Davco Manufacturing Corporation, Ann Arbor, Mich.

[21] Appl. No.: 679,375

[22] Filed: Dec. 6, 1984

[51] Int. Cl.[4] ..... F02M 53/00

[52] U.S. Cl. ..... 123/557; 123/514; 123/516

[58] Field of Search ..... 123/557, 514, 516, 452, 123/467, 512, 513, 187.5, 517

[56] References Cited

U.S. PATENT DOCUMENTS

| | | | |
|---|---|---|---|
| 1,195,764 | 8/1916 | Arquembourg | 123/514 |
| 1,495,315 | 5/1924 | Ball | 123/187.5 R |
| 3,354,872 | 11/1967 | Gratzmuller | 123/557 |
| 3,768,730 | 10/1973 | Campbell | 123/557 |
| 3,962,999 | 6/1976 | Rehm | 123/557 |
| 3,974,809 | 8/1976 | Stumpp | 123/452 |
| 4,003,356 | 1/1977 | Naylor | 123/557 |
| 4,231,342 | 11/1980 | Johnston | 123/513 |
| 4,237,850 | 12/1980 | Connor et al. | 123/557 |
| 4,368,716 | 1/1983 | Davis | 123/557 |
| 4,395,996 | 8/1983 | Davis | 123/557 |
| 4,421,090 | 12/1983 | Davis | 123/557 |
| 4,428,351 | 1/1984 | Davis | 123/557 |
| 4,495,069 | 1/1985 | Davis | 123/557 |

FOREIGN PATENT DOCUMENTS

| | | | |
|---|---|---|---|
| 3241065 | 5/1984 | Fed. Rep. of Germany | 123/557 |
| 610195 | 10/1948 | United Kingdom | 123/517 |

*Primary Examiner*—Ronald B. Cox

*Attorney, Agent, or Firm*—Harness, Dickey & Pierce

[57] ABSTRACT

A fuel delivery system particularly useful for supplying petroleum distillate fuels to a fuel combustion device is described. When such device is operated in cold ambient conditions, fuel clogging can occur in the fuel supply lines. In the past, attempts to overcome such problems have been directed toward applying heat to the portions of the conduits subject to restrictions or by introducing solvents into the fuel. These steps are, however, unsatisfactory. In accordance with this invention, the fuel supply conduits are drained of fuel upon shutdown of the associated engine or other fuel fired device. Upon an engine start-up command, a small quantity of fuel is warmed, preferably using an electric immersion type heater. Once a sufficient fuel temperature is reached, the fuel conduits are reprimed with fuel. Since the fuel does not cold soak in these conduits, fuel clogging problems are eliminated. Various methods for venting the fuel supply conduit enabling such purging and priming is described.

12 Claims, 5 Drawing Figures

PURGE AND PRIME FUEL DELIVERY SYSTEM AND METHOD

BACKGROUND AND SUMMARY OF THE INVENTION

This invention relates to fuel delivery systems and particularly those for transmitting fuel oil to combustion equipment such as diesel cycle internal combustion engines, gas turbine devices, and furnaces.

At sufficiently low temperatures, all engines and other fuel oil fired devices using petroleum based distillate fuels suffer a common problem of paraffin and ice crystal formations which can lead to blockages of fuel flow, particularly at points of restriction such as sharp or right angle bends in the fuel supply conduits, at fuel filters and at fuel filter connection points. Fuels have characteristic temperatures at which they become "cloudy" with suspended wax particles and at which they "freeze" or become a semi-solid mass, referred to as their cloud and pour points, respectively. Some distillate fuels have a cloud point of 20 degrees Fahrenheit and a pour point of 0 degrees Fahrenheit. Clogging in fuel filters and lines is a serious problem and results in reduction or stoppage of fuel flow to the associated combustion apparatus.

A common practice has been to attempt to eliminate fuel system blockages by introducing solvents in the fuel or by heating the components of the fuel delivery system. Although these approaches are effective while the associated device is operating, they are ineffective during periods of idleness where prolonged cold soaking can occur. A major problem, therefore, facing users of fuel oil combustion devices is the cold soak which effectively creates paraffin formation throughout the fuel delivery system, including the conduits connecting the various components thereof. The standard method of eliminating these paraffin formations after cold soak has been to introduce a higher ambient temperature, either by using external heat sources, or by moving the device into a heated building. In order to prevent fuel clogging within the conduits and connections between the various components of a fuel delivery system, it would be necessary to apply external heat to each of these components. Such approach would be inefficient from an energy input standpoint and would further likely not provide the rapid start-up capability which is desired in many applications.

While operating in high ambient temperature environments, distillate fuels can partially vaporize and dissolved gases may precipitate out of solution thereby creating entrapped gas pockets within the fuel delivery circuit. The likelihood of such vapor formations becomes particularly likely in high altitude conditions. This condition, often refered to as vapor lock, creates problems particularly for diesel engines since their fuel injection pumps are not designed to pump gases.

In view of the above, it is an object of this invention to provide a fuel delivery system which provides protection from fuel conduit and fitting restrictions without the requirement of external heat being applied to each of these components. It is a further object of this invention to provide a fuel delivery system capable of delivering warmed fuel to an engine or other combustion device with a minimal warm-up time period. It is another object to provide a fuel delivery circuit which provides protection from fuel line vapor lock. It is yet another object to provide such a system which is inexpensive to provide and simple in operation.

The above objects of this invention are achieved by providing a fuel delivery system having fuel lines which are purged of fuel when the associated device is shut down and reprimed prior to operation to eliminate entrained gases. By purging the fuel conducting conduits of the system, formation of a solidified "plug" of fuel in the lines cannot develop. Prior to start-up of the combustion device, a quantity of fuel is heated and then pumped into the circuit in a liquid state. This invention therefore eliminates the problems associated with fuel solidification occurring in fuel lines during periods of nonuse. The application of this concept is believed to be capable of resulting in a system which is entirely self-sufficient in providing fuel for satisfactory engine start-up and operation even after prolonged periods of exposure to temperatures down to −65 degrees Fahrenheit, when distillant fuels are utilized which become a solid at temperatures well above that temperature. In addition to providing protection from cold weather fuel solidification, several embodiments of this invention provide a return path for gases entrapped within the fuel lines thereby eliminating vapor lock problems when operating in high ambient temperatures.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
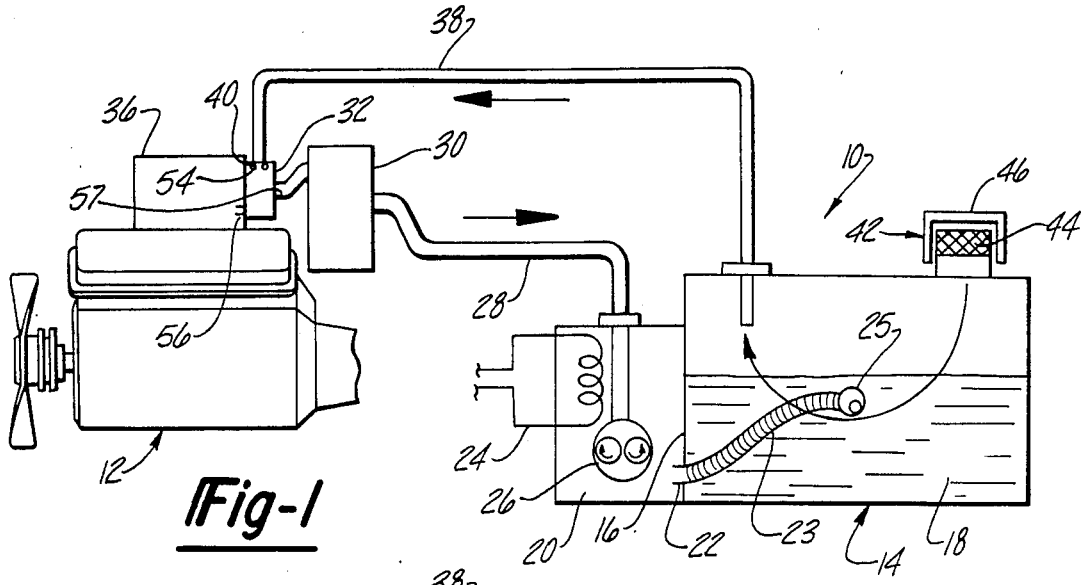
FIG. 1 is a pictorial view of a purge and prime fuel delivery system in accordance with this invention showing a two-cell fuel tank diesel cycle internal combustion engine and fuel conduits in accordance with this invention and further showing the system in a purging operating mode.
Figure 2:
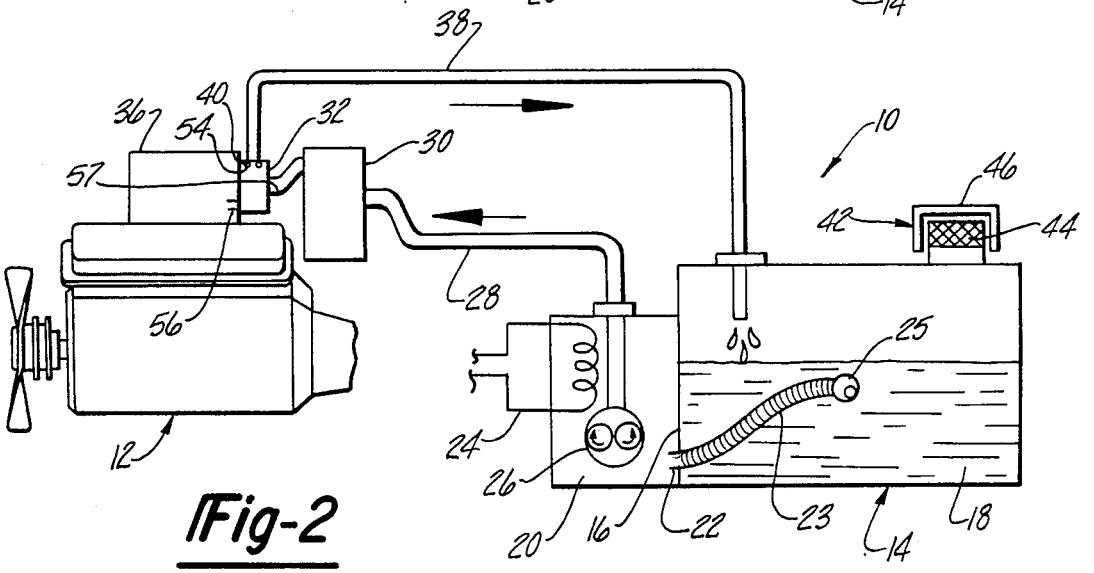
FIG. 2 is a pictorial view of the system depicted in FIG. 1 showing that system in a priming operating mode.

FIGS. 1 and 2 illustrate a purge and prime fuel delivery system in accordance with a first embodiment of this invention, which is generally designated by reference number 10. System 10 is shown as supplying fuel to internal combustion engine 12. However, the concepts and scope of this invention are equally usable when the systems described herein are used to supply distillate fuels to any type of combustion or fuel consuming device.

Fuel tank 14 includes an intermediate wall or partition 16 which divides it into two sections, main fuel reservoir section 18 and fuel heating section 20. These sections are communicated by a port or conduit 22, enabling fuel to flow from main fuel reservoir 18 to fuel heating section 20. Such a fuel tank configuration is described by my previously issued U.S. Pat. No. 4,395,996, which is hereby incorporated by reference. This patent further describes the use of particulate filters mounted within or to the fuel tank. Such concepts are equally adaptable to this invention. In a preferred embodiment, port 22 would communicate with flexible tube 23 having float 25 at its free end. Float 25 has an average density slightly greater than the fuel within tank 14. This arrangement positions float 25 just slightly below the surface of fuel, thereby positioning the fuel inlet away from the cold outer surfaces of tank 14, where solid layers of paraffin may form. Preferably, disposed in fuel heating section 20 is a heating device such as an electric immersion heater 24. Any other type of heat source may, however, be employed, for example; heat tubes, grids, steam or other warm materials. Also preferably installed within fuel heating section 20 is a positive displacement gear type type fuel pump 26 which supplies fuel to fuel supply conduit 28. Alternately, pump 26 may be located anywhere along fuel supply conduit 28. Conduit 28 is shown connected to an optional fuel processor 30. Processor 30 may be of any high-quality processor design to warm fuel, provide water separation therefrom, and may further include a particulate filter element. A number of such fuel processor devices are disclosed by my issued U.S. Pat. Nos. 4,368,716; 4,428,351; 4,421,090; and co-pending patent application Ser. Nos. 463,041, filed Feb. 1, 1983; 573,292, filed Jan. 23, 1984; 575,503, filed Jan. 31, 1984; 624,413 filed June 25, 1984; and 641,866, filed Aug. 17, 1984; which are hereby incorporated by reference. Fuel processor 30 may be heated by any number of means including an additional electric heater or by a conduit which conducts a warmed fluid such as engine coolant, oil or exhaust gases.

The outlet of fuel processor 30 is connected to manifold 32. Manifold 32 has three ports. Port 54 is located at an upper location in the manifold and communicates with vent conduit 38. Port 56 is located at a lower location communicating with injection pump 36. A third port 57 communicates with fuel supply conduit 28. An orifice 40 is provided at the junction between port 54 and vent conduit 38 for a purpose which will be better explained below. Vent conduit 38 communicates with the interior of either of the fuel tank sections 18 or 20 and is shown discharging into main fuel reservoir section 18. Main fuel reservoir 18 further includes tank vent 42 which vents the interior of the tank to the atmosphere and which would preferably include a particulate filter element 44 which prevents the introduction of undesirable contaminants into the interior of fuel tank 14. Hood 46 may be also employed to protect a filter element from debris or precipitation.

The significant advantages according to this invention are provided by substantially or completely purging fuel supplying conduit 28 of liquid fuel after the associated fuel combustion device is shut down. This approach removes any fuel which could become waxed and thereby constitute a fuel delivery restriction from inhibiting fuel flow. Upon a start-up command, initial fuel warming by heater 24 occurs until a small volume of liquified fuel becomes available; thereafter the warmed fuel is pumped through fuel supply conduit 28 and to the associated combustion device.

FIGS. 1 and 2 illustrate the operation of fuel delivery system 10. FIG. 1 includes arrows which indicate the direction of fluid flow within the system when it is being purged. After engine 12 is shut down, a manual or automatic control system commands pump 26 to operate to remove fuel from fuel supply conduit 28 and vent conduit 38. Typically, such operation would be provided by reversing the direction of a positive displacement pump such as a gear type pump, such as is illustated by the figures. Removal of fuel from fuel supply conduit 28 is facilitated by providing means for introducing atmospheric air or other gases into that line. Vent conduit 38 provides this function. As fuel is withdrawn from fuel supply conduit 28 and forced into fuel heating section 20, displaced gases within tank 14 fill vent conduit 38. Additional atmospheric air as needed is conducted within main heating section 20 through tank vent 42. Positive displacement pump 26 is caused to operate for a preselected time period which is sufficient to complete liquid evacuation of fuel supply conduit 28 and any fuel within vent conduit 38. Alternately, a liquid or pressure sensitive detector could be employed at a strategic point in the fuel supply system to control operation of pump 26.

During the purging operation, fuel processor 30 will become drained to a point where fuel supply conduit 28 communicates with the internal volume of the processor. Therefore, it is possible for the development of a solid block of fully waxed fuel in the lower portion of fuel processor 30. However, such development is inconsequential since warmed fuel provided through fuel supply conduit 28 will fill the remainder of fuel processor 30 and flow to its outlet. The accumulated waxed fuel within fuel processor 30 will thereafter become melted over time as the system reaches steady state operating temperatures.

Since a quantity of fuel is continually recirculated to tank 14 through vent conduit 38 while the engine is operating, any gases which develop in fuel supply conduit 28 are removed prior to fuel introduction to injector pump 36, thereby eliminating vapor lock problems.

FIG. 2 illustrates the priming operation of system 10. Arrows indicate the direction of fluid flow in this operating mode. Upon start-up sequence initiation, heat is supplied to fuel heating section 20 by electric immersion heater 24 or by any other heat source. Heat is supplied for a sufficient time period to provide a relatively small quantity of warmed fuel within fuel heating section 20. Once the desired fuel warming phase is complete, positive displacement pump 26 begins operation to force fuel within fuel supply conduit 28. Liquification of fuel is further provided by the shearing of the fuel which occurs as it is conducted through pump 26. Gases within fuel supply conduit 28 are forced through fuel processor 30, manifold 32, and thereafter into vent conduit 38. This process continues until the entire system, including vent conduit 38, is filled with liquid fuel. An orifice 40 is located within vent conduit 38 to insure fuel pressure within manifold 32, thereby providing a supply of fuel for fuel injection pump 36. Alternately, a restrictor may be located elsewhere as the internal diameter of vent conduit 38 may be chosen to provide the desired fluid restriction.

Manifold 32 is shaped so that any bubbles of gases which are entrapped therein will rise to a point where they can be conducted into vent conduit 38 and thereafter into fuel tank 14. This gas separation process is achieved by locating ports 54 and 56 as previously described.

Figure 3:
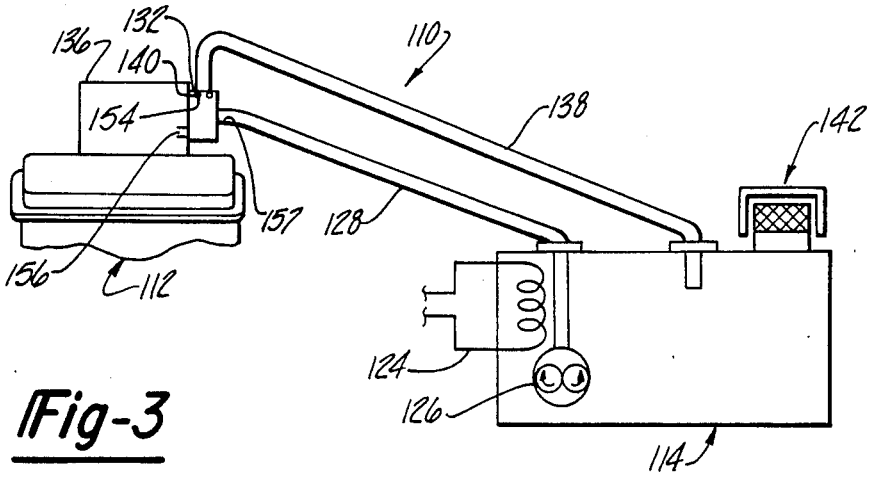
FIG. 3 shows a second embodiment of this invention employing a single-cell fuel tank with an internal combustion engine and providing a simplified system configuration and operating cycle which results from employing gravity purging after engine shut-down.

FIG. 3 illustrates an alternate embodiment of a purge and prime fuel delivery system 110 according to this invention. Fuel delivery system 110, includes fuel tank 114 of conventional one-cell construction having tank vent 142. Electric immersion heater 124, or any other type of heater, may be provided within fuel tank 114. The second embodiment is also disclosed for supplying fuel to internal combustion engine 112, which includes fuel injection pump 136 and manifold 132. Manifold 132 also includes ports 154, 156 and 157 and orifice 140. This second embodiment varies principally from the first in several areas. First, conduits 128 and 138 are sloped so that they are essentially self-draining. In order to provide for such action, it is further necessary to eliminate fittings and local fuel line bends and turns which create regions which will not completely drain of fuel. Due to this self-purging operation, pump 126 need not be of a positive dislacement variety or be capable of evacuating conduit 128. Further, pump 126 may be alternately located within fuel injection pump 136, or engine 112. Pump 126, however, must provide for reverse flow of fuel caused by gravity acting on the column of fuel once it is de-energized. In operation, once pump 126 and internal combustion engine 112 are shut down, fuel will flow back into tank 114 by gravity action, thereby eliminating the requirement of an operation cycle wherein the pump operates in a reverse direction to evacuate the system. Upon engine 112 start-up, pump 126 supplies fuel to conduit 128 and gases are returned to tank 114 by vent conduit 138. The second embodiment also varies from the first in that separate fuel processor 130 is eliminated. The function of fuel processor may be incorporated into tank 14 in accordance with my previously mentioed issued U.S. Pat. No. 4,395,996.

Figure 4:
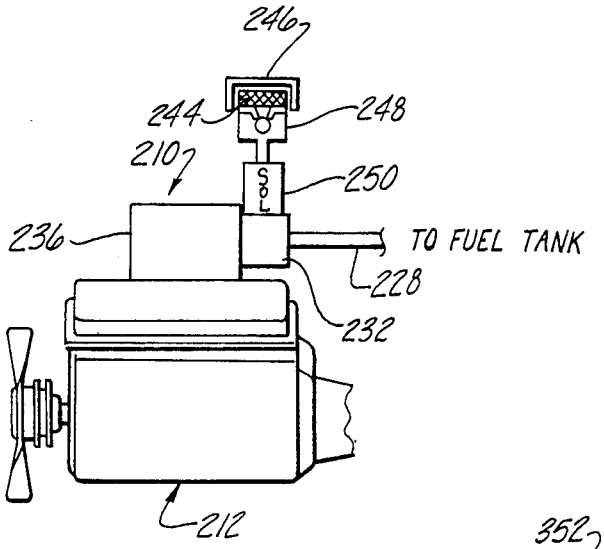
FIG. 4 is a partial pictorial view of a third embodiment according to this invention wherein the vent conduit shown in the first three figures is eliminated, thereby providing a simplified system configuration.

FIG. 4 illustrates a third embodiment of a purge and prime fuel delivery system 210 according to this invention which varies principally from the previously described embodiments in that vent conduit 238 is eliminated. Instead, according to this embodiment, trapped gases within fuel supply conduit are vented to the atmosphere directly rather than being conducted back into the fuel tank. In order to prevent fuel leakage, it is necessary to employ vent valve 248 such as a float operated device which automatically closes when liquid fuel fills an internal chamber thereof. Like tank vent 42, vent valve 248 preferably includes a particulate filter 244 and may further include hood 246. When the fuel pressure within fuel supply conduit 228 falls, indicating fuel supply pump de-energization, vent valve 248 provides an atmospheric vent either by employing an internal pressure-responsive element or by operation of a solenoid valve 250 which creates an atmospheric vent permitting drainage of fuel supply conduit 228. Such purging may occur through gravity or pump assists, as earlier detailed.

The third ebodiment shown in FIG. 4 not only features the elimination of vent conduit 38, but further discloses the use of solenoid valve 250. Such a valve may be eployed to replace orifices 40 and 140 described in conjunction with the previous embodiments and would close once fuel supply conduit 228 is filled with gas-free liquid fuel. The control logic for such operation of solenoid valve could be either to shut it after a preselected time period or to use a strategically located liquid sensor. Solenoid valve 250 could also be employed with the first described embodiments in place of orifices 40 and 140. The use of a solenoid valve in those applications would enable pumps 26 and 126 to operate at a lower output capacity since a portion of its output would not be returned to the fuel tank but instead its entire discharge would be directed to the associated fuel consuming device.

Figure 5:
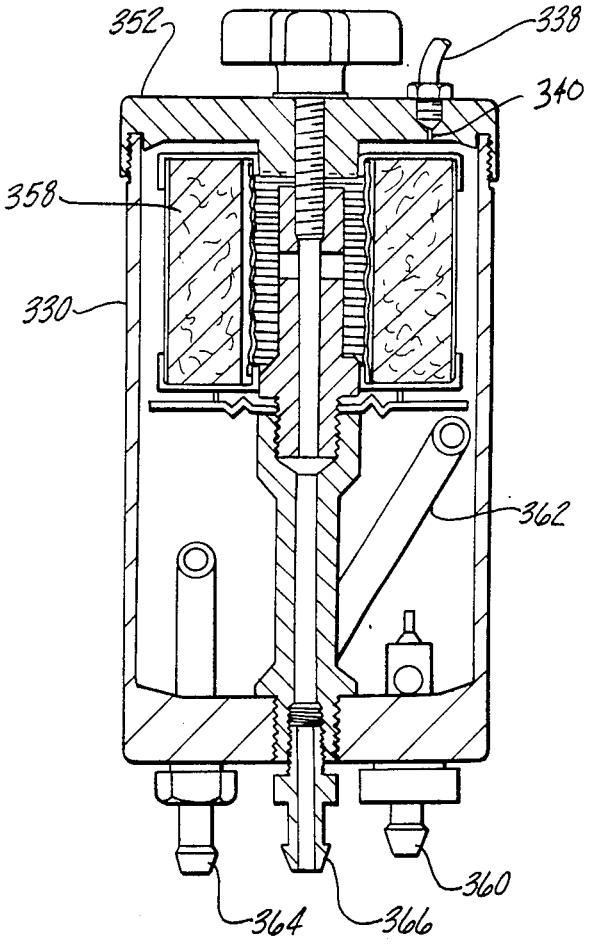
FIG. 5 is a cross-sectional view of a fuel processor which may be employed in conjunction with this invention, including an orifice and port for connection of the vent conduit shown in the first three figures.

FIG. 5 illustrates a modified fuel processor 330 useful in connection with a purge and prime fuel delivery system 310 accoding to a fourth embodiment of this invention. Fuel processor 330 could be employed in the system described in conjunction with FIGS. 1 and 2. This embodiment differs, however, in that vent conduit 338 is connected directly to a top plate 352 of fuel processor 330 rather than to a manifold connected to the engine fuel injection pump. Orifice 340 is formed by the restricted internal diameter of the bore within top plate 352. This configuration also eliminates the necessity of providing a manifold as earlier described. This embodiment has advantages in that the vent conduit connection is easily provided merely by drilling and tapping top plate 352 of fuel processor 330. A potential disadvantage of this embodiment, however, is the fact that any conduits communicating fuel processor 330 with fuel injection pump 336 (not shown) is not provided with a vent and therefore may not be effectively drained after engine shut-down. However, this advantage may be insignificant if fuel clogging in that conduit is unlikely due to other factors, such as it being in an enclosed warmed cavity or where the conduit is very short in length between these components. Fuel processor 330 shown in FIG. 5 is of a type described by issued U.S. Pat. No. 4,428,351 and includes for illustrative purposes particulate filter 358, drain valve 360, immersion heater 362, and fuel inlet and outlet ports 364 and 366, respectively. However, other types of fuel processors could be also employed in conjunction with this embodiment of the invention.

While preferred embodiments of the invention have been described herein, it will be appreciated that various modifications and changes may be made without departing from the spirit and scope of the appended claims.

What is claimed is:

1. A method of preventing fuel clogging in a fuel delivery system of a combustion device due to exposure to low temperatures, said fuel delivery system of the type having a fuel tank and a fuel supply conduit for transmitting said fuel from said fuel tank to said combustion device and a fuel pump for pumping said fuel from said fuel tank to said combustion device comprising the steps of;

providing a vent means for said fuel supply conduit, purging said fuel supply conduit of fuel when said combustion device is inoperative, said vent means acting to supply gas to said fuel supply conduit during said purging step, whereby substantially all of said fuel is removed from said fuel supply conduit and returned to said fuel tank such that said fuel supply conduit is not subjected to fuel waxing or clogging therein caused by said exposure to low temperatures, and priming said fuel supply conduit with said fuel prior to operating said combustion device by energizing said fuel pump, said vent means acting to provide an escape for gases trapped in said fuel supply conduit whereby said fuel is available for said combustion device.

2. A method of preventing fuel clogging in a fuel delivery system of a combustion device due to exposure to low temperatures, said fuel delivery system of the type having a fuel tank and a fuel supply conduit for transmitting said fuel from said fuel tank to said combustion device and a fuel pump for pumping said fuel from said fuel tank to said combustion device, comprising the steps of;

providing a vent means for said fuel supply conduit, providing fuel pump means for pressurizing and evacuating said fuel supply conduit, purging said fuel supply conduit of said fuel when said combustion device is inoperative by causing said fuel pump to evacuate said fuel supply conduit, said vent means acting to supply gas to said fuel supply conduit during said purging whereby fuel is substantially completely removed from said fuel supply conduit and returned to said fuel tank such that said fuel supply conduit is not subject to fuel waxing or clogging therein caused by said exposure to low temperatures, and priming said fuel supply conduit with fuel prior to operating said combustion device by energizing said fuel pump, said vent means acting to provide an escape for gases trapped in said fuel supply conduit whereby said fuel is available for said combustion device.

3. A method of preventing fuel clogging in a fuel supply conduit of a combustion device due to exposure to low temperatures comprising the steps of;

providing a vent means for said fuel supply conduit, purging said fuel supply conduit of fuel when said combustion device is inoperative, said vent means acting to supply gas to said fuel supply conduit during said purging step, whereby said fuel is removed from said fuel supply conduit and is therefore not subjected to fuel waxing or clogging therein, priming said fuel supply conduit with said fuel prior to operating said combustion device, said vent means acting to provide an escape for gases trapped in said fuel supply conduit whereby said fuel is available for said combustion device, and heating said fuel prior to priming of said fuel supply conduit.

4. A method of preventing fuel clogging in a fuel supply conduit of a combustion device due to exposure to low temperatures comprising the steps of;

providing a vent means for said fuel supply conduit, providing a fuel pump adapted to pressurize and evacuate said fuel supply conduit, purging said fuel supply conduit of said fuel when said combustion device is inoperative by causing said fuel pump to purge said fuel supply conduit, said vent means acting to supply gas to said fuel supply conduit during said purging whereby fuel is removed from said fuel supply conduit and is therefore not subject to waxing or clogging, priming said fuel supply conduit with said fuel prior to operating said combustion device, said vent means acting to provide an escape for gases trapped in said fuel supply conduit whereby fuel is available for said combustion device, and heating said fuel prior to priming said fuel supply conduit.

5. The method according to claim 1 further comprising; heating said fuel prior to priming of said fuel supply conduit.

6. The method according to claim 1 wherein said vent means continually vents said fuel supply conduit whereby gases within said fuel supply conduit are vented therefrom.

7. The method according to claim 1 wherein said vent means comprising a conduit which communicates with said fuel supply conduit and said fuel tank.

8. The method according to claim 1 further comprising; restricting flow within said vent conduit whereby fuel pressure may be supplied to said combustion device.

9. The method according to claim 2 further comprising; heating said fuel prior to priming of said fuel supply conduit.

10. The method according to claim 2 wherein said vent means continually vents said fuel supply conduit whereby gases within said fuel supply conduit are vented therefrom.

11. The method according to claim 2 wherein said vent means comprising a conduit which communicates with said fuelsupply conduit and said fuel tank.

12. The method according to claim 2 further comprising; restricting flow within said vent conduit whereby fuel pressure may be supplied to said combustion device.

* * * * *

UNITED STATES PATENT AND TRADEMARK OFFICE

CERTIFICATE OF CORRECTION

PATENT NO. : 4,706,636

DATED : November 17, 1987

INVENTOR(S) : Leland L. Davis

It is certified that error appears in the above-identified patent and that said Letters Patent is hereby corrected as shown below:

Col. 1, Line 55, "refered" should be -- referred --

Col. 3, Line 24, delete "type" (second Occurrence)*

Col. 5, Line 21, "dislacement" should be -- displacement --

Col. 5, Line 37, "mentioed" should be -- mentioned -- *

Col. 5, Line 60, "ebodiment" should be -- embodiment --

Col. 5, Line 63, "eployed" should be -- employed --

Col. 6, Line 11, "accoding" should be -- according --

Col. 8, Line 44, Claim 11,
"fuelsupply" should be -- fuel supply --

Signed and Sealed this

Seventeenth Day of May, 1988

*Attest:*

*Attesting Officer*

DONALD J. QUIGG

*Commissioner of Patents and Trademarks*